US006518489B2

(12) United States Patent
Epping

(10) Patent No.: US 6,518,489 B2
(45) Date of Patent: Feb. 11, 2003

(54) HARMONICA COMB

(76) Inventor: William R. Epping, 108 N. James St., Ashland, VA (US) 23005

( * ) Notice: Subject to any disclaimer, the term of this patent is extended or adjusted under 35 U.S.C. 154(b) by 0 days.

(21) Appl. No.: 09/833,157

(22) Filed: Apr. 12, 2001

(65) Prior Publication Data

US 2002/0157519 A1 Oct. 31, 2002

(51) Int. Cl.[7] ..... G10D 7/102
(52) U.S. Cl. ..... 84/377; 84/378; 84/379
(58) Field of Search ..... 84/377, 378, 379; 446/298, 195, 213, 202, 216

(56) References Cited

U.S. PATENT DOCUMENTS 5,367,937 A * 11/1994 Epping ..... 84/377
5,739,446 A * 4/1998 Bahnson ..... 84/377
6,175,067 B1 * 1/2001 Lambert ..... 84/377
6,326,532 B1 * 12/2001 Antaki ..... 84/377
6,359,204 B2 * 1/2002 Antaki ..... 84/377

* cited by examiner

*Primary Examiner*—Kim Lockett

(57) ABSTRACT

An improved comb for a harmonica including one or more check valves mounted within the comb for improving performance and tonality and simplifying construction. The use of check valves mounted over valve slots has been previously disclosed as a method of increasing the musical range and volume of the instrument. This invention incorporates check valves but locates them within the comb of the harmonica. By placing all the check valves within the comb, construction of the harmonica is greatly simplified, air loss between various components is greatly decreased, and check valves are removed from close proximity with reeds thereby decreasing interference with the reeds, increasing volume and performance, and increasing the resonance of overtones.

10 Claims, 5 Drawing Sheets

HARMONICA COMB

FIELD OF THE INVENTION

This invention relates to harmonicas or mouth organs and specifically to situating check valves within the comb of a harmonica. A previous patent incorporated check valves mounted on valve platforms, external to the reed plates of the harmonica, to improve musical range and volume. In this invention, check valves are mounted over slots situated internally between the mouth and the reeds to provide further improvements in performance and tonality. The central cells may be called valve cells. Employing a single internal valve cell in place of two external valve cells improves airtight performance, permits all reeds to be situated externally to the comb where their vibration is in direct contact with the outside air and simplifies construction by reducing the required number of components.

BACKGROUND OF THE INVENTION

Check valves, or reed valves, are commonly used in the reed cells of harmonicas to improve performance. Reed valves are typically installed to control the flow of air within the harmonica. A reed valve, when attached to the external side of a reed slot to which an exhale-actuated or blow reed is secured, will serve to prevent inhaled air from passing by the blow reed when an inhale-actuated or draw reed associated with the same mouthpiece opening is being played. Likewise, a reed valve, when attached to the opposing side of a reed slot to which a draw reed is secured, will serve to prevent exhaled air from passing by the draw reed when a blow reed associated with the same mouthpiece opening is being played. For low-pitched and mid-range reeds the benefit of reduced air loss provided by reed valves outweighs the negative effects of their close proximity to the reeds. However, the amount of air that can be prevented from passing through the relatively small and constricted reed slots of high-pitched reeds, while considerable, may not be enough to outweigh the negative proximity effects of reed valves. For this reason, reed valves are usually omitted from the highest-pitched reeds of harmonicas incorporating reed valves.

U.S. Pat. No. 5,367,937 disclosed the use of one or more valve cells separate from the reed cell of the harmonica. In this patent, check valves were mounted external to the reed plates and the reeds. One embodiment of '937 disclosed two valve cells associated with each mouthpiece opening, situated externally from the mouth, reed cell and reed plates.

In '937, as air is exhaled into the harmonica, the blow valve cells and blow valves permit exhaled air to flow past the blow reeds and blow enabler reeds while, at the same time, exhaled air is prevented from flowing past the draw reeds and draw enabler reeds by the draw valve cells and draw valves. The draw valve cells and draw valves function to permit inhaled airflow past the draw reeds and draw enabler reeds while, at the same time, the blow valve cells and blow valves prevent inhaled airflow past the blow reeds and blow enabler reeds.

The design of the harmonica disclosed in '937 requires the construction of three separate bodies to be assembled with two reed plates. These three bodies, defined in U.S. Pat. No. '937 as the comb, blow platform, and draw platform, are essentially three separate combs. Comparing the harmonica of '937 to a prior art harmonica that has a comb but no valve platforms, this design would be relatively expensive to produce, both in tooling and assembly costs. Furthermore, the four interfaces that occur between the comb, blow platform, draw platform, and each reed plate create a significant area susceptible to air loss. A standard harmonica, having only two interfaces between the comb and two reed plates, is significantly less liable to air loss than the harmonica of U.S. Pat. No. '937. As the harmonica of U.S. Pat. No. '937 is played, air losses through any of the four existing interfaces result in decreased volume and performance. Placement of the external valve cells between the reeds and the outside air, as disclosed in U.S. Pat. No. '937, also reduces the amplitude of the overtones of the vibrating reeds. Because players can reduce the amplitude of the overtones of vibrating reeds when desirable by cupping the harmonica with their hands, but cannot increase the amplitude of the overtones of the vibrating reeds in a similar manner, harmonicas producing resonant overtones are generally preferred over harmonicas lacking in resonant overtones.

The disadvantages of harmonicas having check valves located between the reeds and the outside air are:

(a) The close proximity of reed valves to reeds in standard chromatic and standard diatonic harmonicas causes a reduction of volume and resonance, particularly with high-pitched reeds.

(b) A harmonica incorporating external valve cells, requiring three combs instead of one, can be expensive to produce compared to harmonicas with no external valve cells and one comb.

(c) A harmonica incorporating external valve cells is subject to high air loss compared to harmonicas with no external valve cells.

(d) A harmonica incorporating external valve cells produces a tonality deficient in resonant overtones compared to harmonicas with no external valve cells.

SUMMARY OF THE INVENTION

U.S. Pat. No. 5,367,937 disclosed the use of check valves mounted on valve platforms thereby creating two types of external valve cells, or valve cells external to the comb and reed plates of the harmonica, associated with each central cell, to improve musical range and volume. The first set of valve cells, the blow valve cells, contained valves that were actuated when air was blown into the harmonica. The second set of valve cells, the draw valve cells, contained valves that were actuated when air was inhaled from the harmonica.

In the present invention, check valves are mounted over slots situated between the mouth and the reeds, thereby creating internal valve cells, or valve cells within the comb, to provide further improvements in performance and tonality. Employing a single internal valve cell in place of two external valve cells improves airtight performance, permits all reeds to be situated externally to the comb where their vibration is in direct contact with the outside air and simplifies construction by reducing the required number of components.

OBJECTS AND ADVANTAGES

Accordingly, several objects and advantages of this invention are:

(a) To reduce the negative tonal effects of reed valves in standard chromatic and diatonic harmonicas by removing them from close proximity to the reeds.

(b) To lower the production cost of harmonicas incorporating valve cells.

(c) To reduce the amount of air loss in harmonicas incorporating valve cells.

(d) To increase the resonance of the overtones in harmonicas incorporating valve cells.

DESCRIPTION OF THE INVENTION

Figure 1:
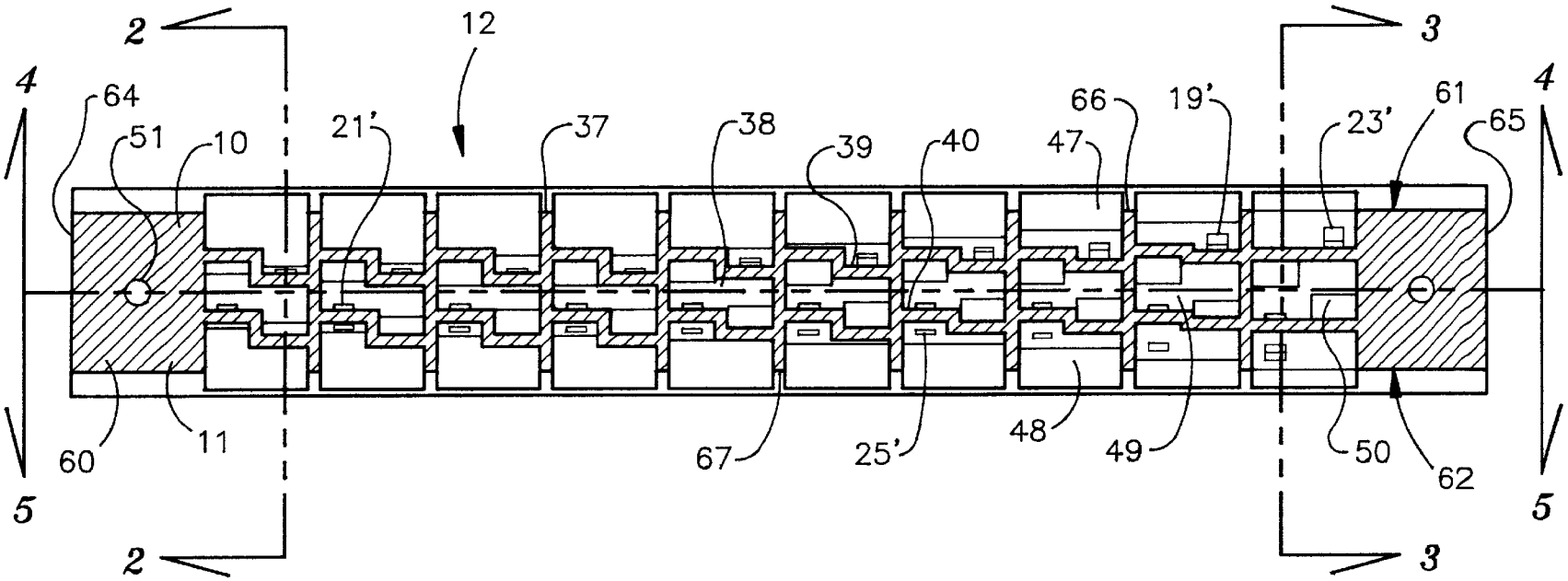
FIG. 1 is a front elevational view of the section indicated by plane 1—1 of the two-piece harmonica comb in FIG. 2 and FIG. 3. The reed plates are included in FIG. 2 and FIG. 3 but are absent from FIG. 1.
Figure 2:
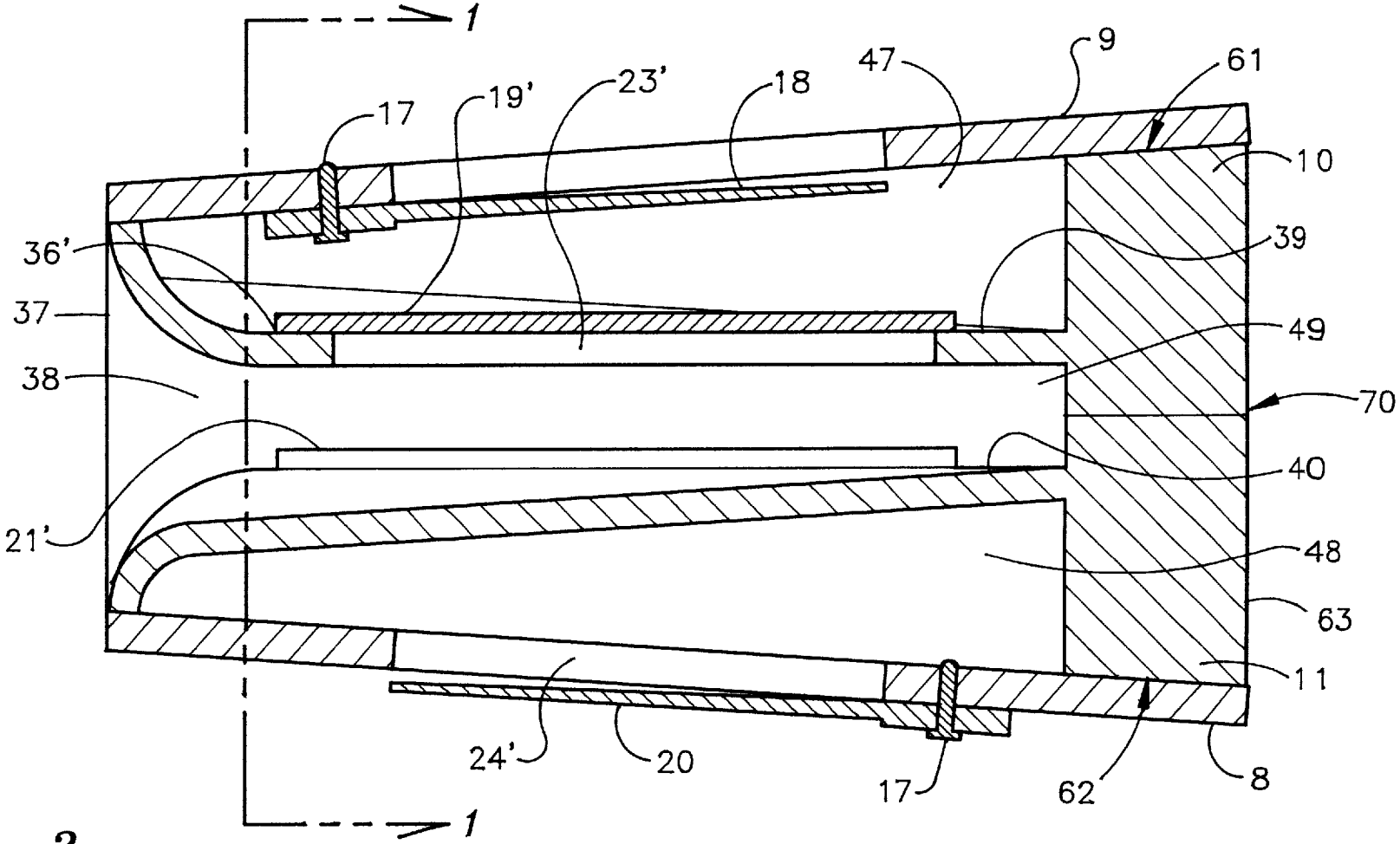
FIG. 2 is a sectional view, indicated by plane 2—2 of FIG. 1, showing approximately one half of the first cell, or cell for the lowest pitched reeds, of the harmonica comb, with reed plates attached.
Figure 3:
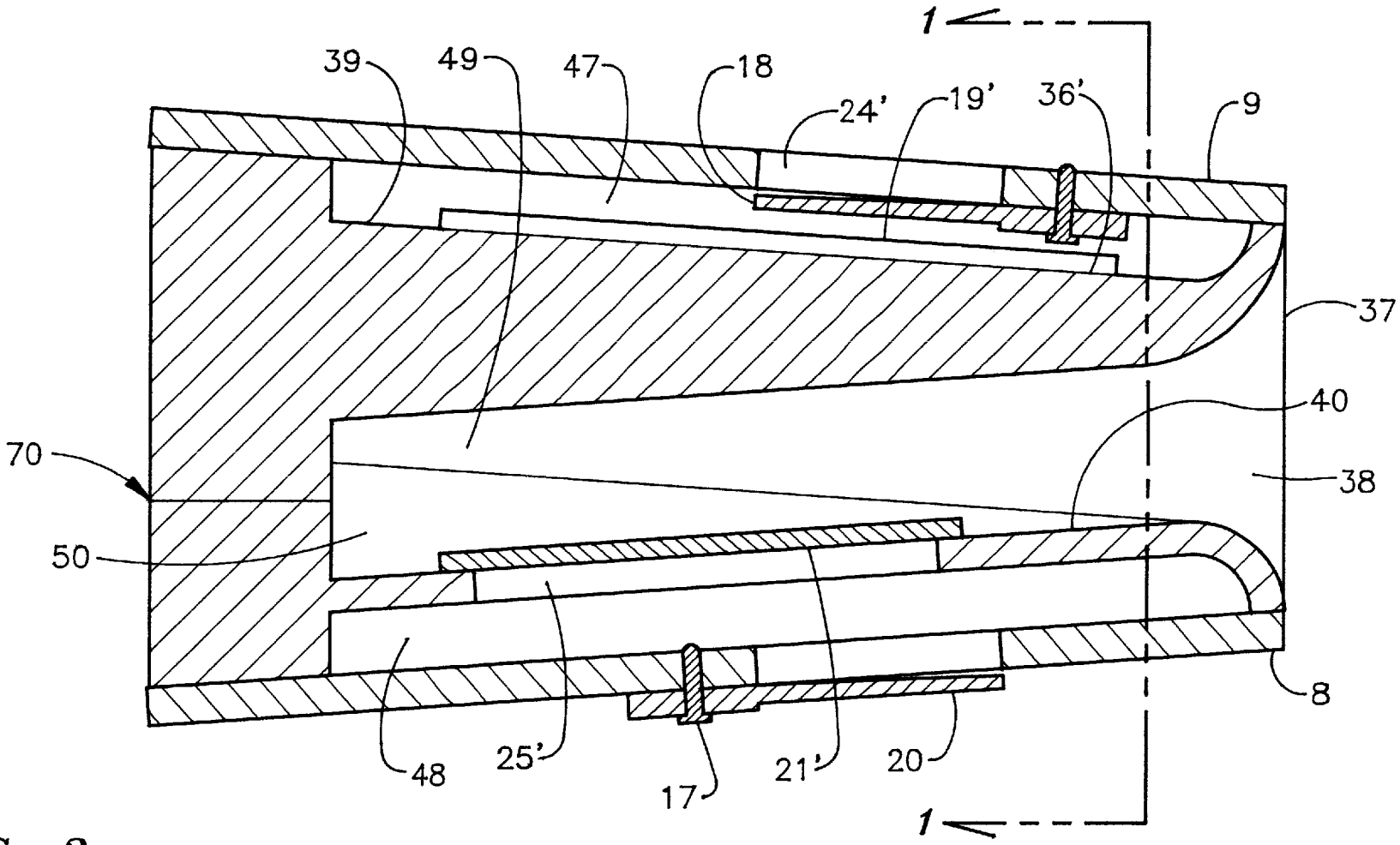
FIG. 3 is a sectional view, indicated by plane 3—3 of FIG. 1, showing one half of the last cell, or cell for the highest pitched reeds, of the harmonica comb, with reed plates attached.

FIG. 1 is a front elevational view of the section indicated by plane 1—1 of the preferred embodiment of a two-piece harmonica comb 12 in FIG. 2 and FIG. 3. The upper piece 10 of the two-piece comb is indicated by plane 4—4 and the lower piece 11 of the two-piece comb is indicated by plane 5—5.

The novelty of this invention which distinguishes it over the prior art is the placement of the reed valves, of which there are two types shown in FIG. 1: blow reed/blow enabler reed valves 19' and draw reed/draw enabler reed valves 21'.

The two-piece comb 12 is joined together in FIG. 1 as it will be upon final assembly. This figure depicts a common ten-cell harmonica. The joined comb pieces form an essentially rectangular comb body 12 including a front side 60, a top adjacent side 61, a bottom adjacent side 62, a rear side (not shown in FIG. 1), a low-pitched end 64 and a high-pitched end 65, with the thickness of the comb 12 typically wider from front 60 to rear than from top 61 to bottom 62. Valve cells 49 are created centrally along the longitudinal body of the comb after the upper piece 10 and lower piece 11 are joined. The valve cells 49 are separated by cell walls 37 shown spaced apart at intervals along the comb 12. A longitudinal portion of the upper piece 10 of the comb forms a blow valve platform 39 within the comb 12. Top cell wall extensions 66 create blow reed/blow enabler reed cells 47 spaced along the top adjacent side 61 of the comb with each blow reed/blow enabler reed cell 47 sharing a portion of the blow valve platform 39. Blow reed/blow enabler reed valve slots 23' are apertures in the blow valve platform 39 allowing a passageway for air to flow between each valve cell 49 and its associated blow reed/blow enabler reed cell 47. A blow reed/blow enabler reed valve 19' is secured at one of its ends above each blow reed/blow enabler reed valve slot 23'. Positioning the blow reed/blow enabler reed valve 19' on the blow valve platform 39 therefore moves the valve within the comb 12 thereby distinguishing this invention over prior art. This positioning of the blow reed/blow enabler reed valve 19' provides separation of the valve from the blow reeds, which will be mounted on a reed plate (not shown in FIG. 1) exterior to the comb 12 on the top adjacent side 61, thereby reducing the negative tonal effects of reed valves in prior art harmonicas, and increasing the resonance of overtones. By positioning the blow reed/blow enabler reed valves 19' within the comb, less components are required as in prior art harmonicas with valves thereby providing the additional benefits of less air loss between components and lowering the cost of production.

A longitudinal portion of the lower piece 11 of the comb forms a draw valve platform 40 within the comb 12. Bottom cell wall extensions 67 create draw reed/draw enabler reed cells 48 spaced along the bottom adjacent side 62 of the comb 12 with each draw reed/draw enabler reed cell 48 sharing a portion of the draw valve platform 40. Draw reed/draw enabler reed valve slots 25' are apertures in the draw valve platform 40 allowing a passageway for air to flow between each valve cell 49 and its associated draw reed/draw enabler reed cell 48. A draw reed/draw enabler reed valve 21' is secured at one of its ends above each draw reed/draw enabler reed valve slot 25'. Positioning the draw reed/draw enabler reed valve 21' on the draw valve platform 40 thereby moves the valve within the comb 12, distinguishing this invention over prior art. This positioning of the draw reed/draw enabler reed valve 21' provides separation of the valve from the draw reeds, which will be mounted on a reed plate (not shown in FIG. 1) exterior to the comb 12 on the bottom adjacent side 62, thereby reducing the negative tonal effects of reed valves in prior art harmonicas, and increasing the resonance of overtones. By positioning the draw reed/draw enabler reed valves 21' within the comb, less components are required as in prior art harmonicas with valve cells thereby providing the additional benefits of less air loss between components and lowering the cost of production.

The upper comb piece 10 and lower comb piece 11 are typically constructed of wood or plastic. A typical plastic employed for comb construction is ABS. The elasticity of the ABS may be specified such that the two pieces may be secured together by screws (not shown in FIG. 1) and thereby form an air tight junction. Alternatively, the pieces may be secured with adhesive or other commonly known means.

The blow reed/blow enabler reed valves 19' and the draw reed/draw enabler reed valves 21' are typically constructed of plastic, which may be mylar, PVC, or any thin resilient non-permeable material.

FIG. 2 is a sectional view of the comb 12, indicated by plane 2—2 of FIG. 1, showing approximately one half of the first trio of cells, or cells for the lowest pitched reeds of the harmonica comb 12 and depicting the reed plates attached. A separation line 70 is depicted showing the junction between the upper piece 10 and lower piece 11 of the comb. The upper piece 10 of the comb 12 has a valve cell 49 at its center with the comb's integral blow valve platform 39 forming a ceiling for the valve cell 49. The lower piece 11 of the comb 12 includes an integral draw valve platform 40 forming a floor for the valve cell 49. When joined, as shown in FIG. 2, the upper piece 10 and lower piece 11 of the comb in conjunction with the cell walls 37 form the valve cells 49 in the central portion of the comb 12. The top extension of the cell wall 66 (not shown in FIG. 2) and the blow valve platform 39 create a blow reed/blow enabler reed cell 47. The top adjacent side 61 of the upper piece 10 of the comb 12 is secured to a blow reed/blow enabler reed plate 9 in an airtight fit. The bottom extension of the cell wall 67 (not shown in FIG. 2) and the draw valve platform 40 create a draw reed/draw enabler reed cell 48. The bottom adjacent side 62 of the lower piece 11 of the comb 12 is secured to a draw reed/draw enabler reed plate 8 in an airtight fit.

FIG. 2 further depicts a blow reed/blow enabler reed valve slot 23' formed in the blow valve platform 39. The blow reed/blow enabler reed valve slot 23' provides an air passageway between the valve cell 49 and the blow reed/blow enabler reed cell 47. Mounted on the upper side of the blow valve platform 39 is the blow reed/blow enabler reed valve 19', which is attached to the blow valve platform 39 at one end, depicted by the adhesive line 36', and is free at its opposite end. A blow reed/blow enabler reed plate 9 is secured to the top adjacent side 61 of the comb 12 and includes a blow reed 18 secured by a rivet 17 at one end.

The lower portion of FIG. 2 depicts a draw reed/draw enabler reed valve 21'. Mounted on the upper side of the draw valve platform 40, directly above the draw reed/draw enabler reed valve slot (not shown in FIG. 2) is the draw reed/draw enabler reed valve 21', which is attached to the draw valve platform 40 at one of its ends, depicted by the adhesive line 36', and is free at its opposite end. A draw reed/draw enabler reed plate 8 is secured to the bottom adjacent side 62 of the comb 12 and includes a draw reed 20 secured by a rivet 17 at one end.

As air is blown into the mouthpiece opening 38 of the valve cell 49 shown in FIG. 2, the blow reed/blow enabler reed valve 19' opens in response to the high pressure in the valve cell 49 and the draw reed/draw enabler reed valve 21' is held shut. The air passing through the blow reed/blow enabler reed valve slot 23' and the open blow reed/blow enabler reed valve 19' passes into the blow reed/blow enabler reed cell 47 and then past the blow reed 18 causing it to vibrate and create a musical note. Although not shown in FIG. 2, a blow enabler reed may also be mounted to the blow reed/blow enabler reed plate 9, and this blow enabler reed may be caused to vibrate in response to the harmonica player blowing air and adjusting his mouth and throat to a resonant frequency suitable for note bending.

FIG. 3 is a sectional view of the comb 12, indicated by plane 3—3 of FIG. 1, showing approximately one half of the last trio of cells, or cells for the highest pitched reeds of the harmonica comb 12 and depicting the reed plates attached. The valve cell 49 is located between the blow valve platform 39 and the draw valve platform 40. A draw reed/draw enabler reed valve slot 25' forms an air passageway between the valve cell 49 and the draw reed/draw enabler reed cell 48. A flexible draw reed/draw enabler reed valve 21' is secured at the adhesive line 36' to the upper surface of the draw valve platform 40.

As air is drawn from the mouthpiece opening 38 of the valve cell 49 shown in FIG. 3, the draw reed/draw enabler reed valve 21' opens in response to the low pressure in the valve cell 49 and the blow reed/blow enabler reed valve 19' is held shut. The air passing through the draw reed/draw enabler reed valve slot 25' and the open draw reed/draw enabler reed valve 21' evacuates from the draw reed/draw enabler reed cell 48 thereby pulling outside air past the draw reed 20 causing it to vibrate and create a musical note. Although not shown in FIG. 3, a draw enabler reed may also be mounted to the draw reed/draw enabler reed plate 8, and this draw enabler reed may be caused to vibrate in response to the harmonica player drawing air while adjusting his mouth and throat to a resonant frequency suitable for note bending.

Figure 4:
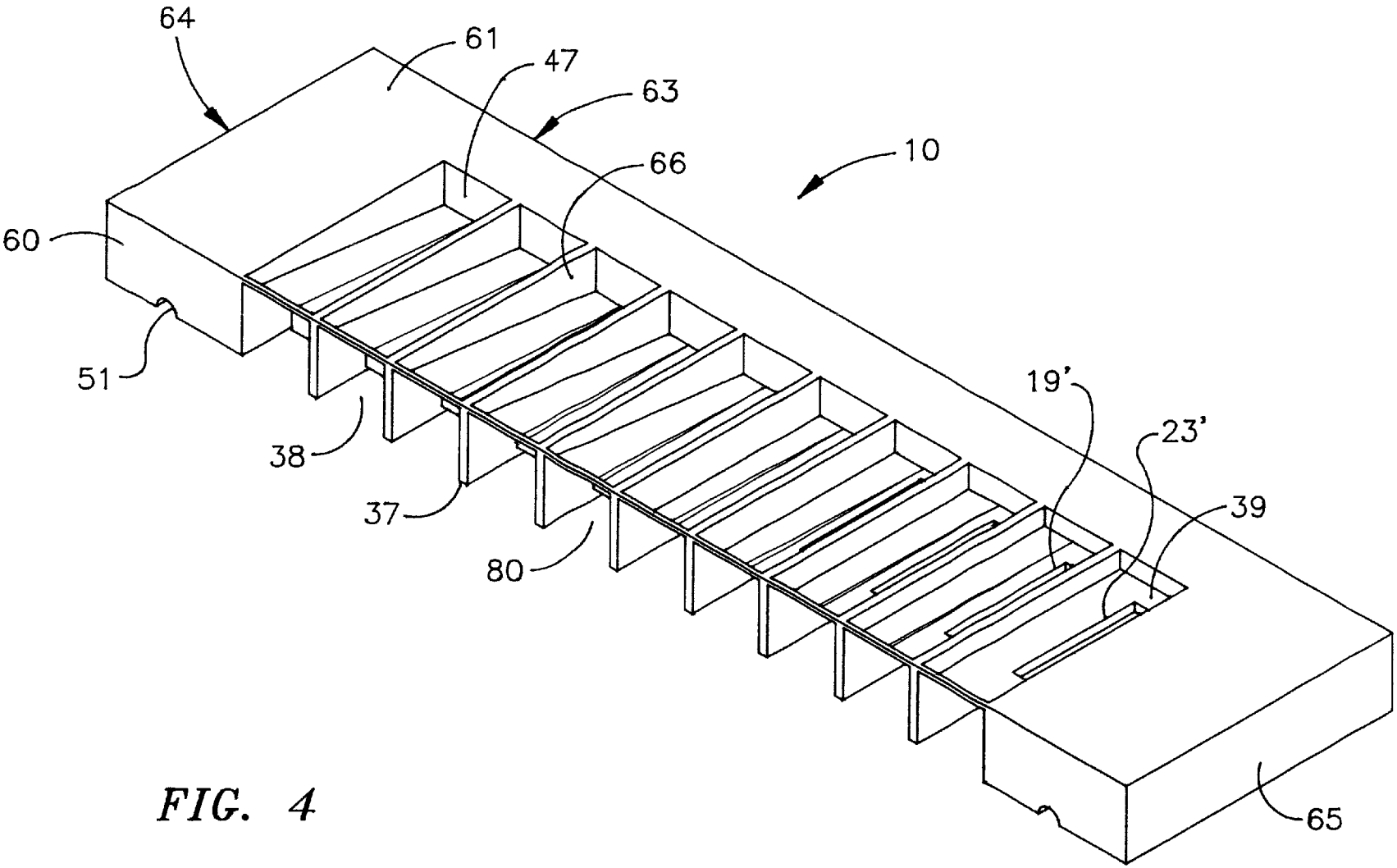
FIG. 4 is a perspective view of the upper section of the two-piece harmonica comb in FIG. 1, indicated by plane 4—4 of FIG. 1, showing the blow reed/blow enabler reed cells and the blow valve platforms.

FIG. 4 is a perspective view of the upper piece 10 of the harmonica comb in FIG. 1, indicated by plane 4—4 of FIG. 1. The upper piece 10 is typically machined from wood or molded of plastic. The upper piece 10 is an elongated essentially rectangular body including a front side 60, a top adjacent side 61, a rear side 63, and two ends with a low-pitched end 64 on the left side of FIG. 4 and a high-pitched end 65 on the right side of FIG. 4. A series of blow reed/blow enabler reed cells 47 are molded into the top adjacent side 61. Each blow reed/blow enabler reed cell 47 includes a blow valve platform 39 in the bottom of each cell. A blow reed/blow enabler reed valve slot 23' is formed through the blow valve platform 39 that is located at the bottom of each blow reed/blow enabler reed cell 47. A blow reed/blow enabler reed valve 19' is positioned above each blow reed/blow enabler reed valve slot 23' and is secured at one end to the blow valve platform 39 with the other end unsecured and free to move. A series of cell walls 37 are spaced apart along the lower surface of the upper piece 10 of the comb. Each pair of cell walls 37 defines an upper channel 80 that is open to the front side 60 and closed at the rear. When the upper piece 10 is later aligned and secured to the lower piece 11 (not shown in FIG. 4), the upper channels 80 of the upper piece 10 and lower channels 81 of the lower piece 11 (not shown in FIG. 4) will combine to form the valve cells.

Figure 5:
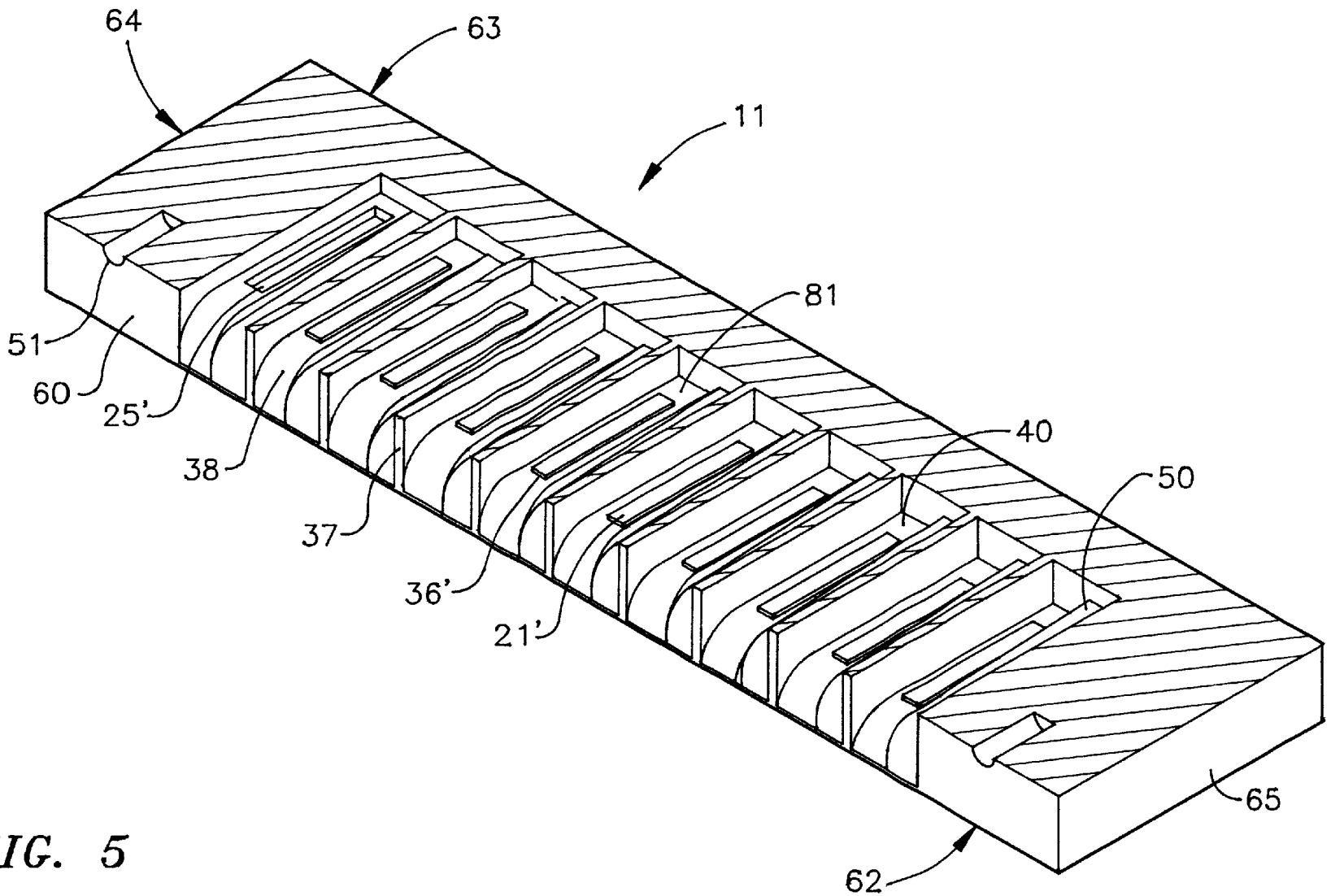
FIG. 5 is a perspective view of the lower section of the harmonica comb in FIG. 1, indicated by plane 5—5 of FIG. 1, showing the lower halves of the valve cells and the draw valve platforms.

FIG. 5 is a perspective view of the lower piece 11 of the harmonica comb in FIG. 1, indicated by plane 5—5 of FIG. 1. The lower piece 11 is typically machined from wood or molded of plastic. The lower piece 11 is an elongated essentially rectangular body including a front side 60, a bottom adjacent side 62, a rear side 63, and two ends with a low-pitched end 64 on the left side of FIG. 5 and a high-pitched end 65 on the right side of FIG. 5. A series of draw reed/draw enabler reed cells 48 are molded into the bottom adjacent side 62 (not shown in FIG. 5) and a series of lower channels 81 are molded into the top of the lower piece. A draw valve platform 40 is included in the bottom of each lower channel 81. A draw reed/draw enabler reed valve slot 25' is formed through the draw valve platform 40 that is located at the bottom of lower channel 81. A draw reed/draw enabler reed valve 21' is positioned above each. draw reed/draw enabler reed valve slot 25' and is secured at one end to the draw valve platform 40 with the other end unsecured and free to move. A series of cell walls 37 are spaced apart along the upper surface of the lower piece 11 of the comb. Each pair of cell walls 37 defines a lower channel 81 that is open to the front side 60 and closed at the rear side 63. When the lower piece 11 is later aligned and secured to the upper piece 10 (not shown in FIG. 5), the upper channels 80 of the upper piece 10 and the lower channels 81 of the lower piece 11 will combine to form the valve cells.

FIGS. 1, 2, 3, 4 and 5 show a preferred embodiment that is designed to have two reeds adjacent to each reed cell, four reeds being associated with each mouthpiece opening. This embodiment is suitable for bending harmonicas as well as for standard octave and tremolo harmonicas.

A second embodiment has one reed adjacent to each reed cell, four reed cells and four reeds being associated with each mouthpiece opening. Two of these four reeds can be blow reeds and the other two draw reeds. This second embodiment can be incorporated into a chromatic harmonica and can include the addition of a chromatic harmonica style slide apparatus that will permit the selection of one blow reed and one draw reed while blocking the other two reeds associated with the same mouthpiece opening. The second embodiment will provide the tonal advantages of the internal valve cell and permit reed valves to be utilized in association with every reed, including those of the highest-pitch cell, without the disadvantages created by standard reed valves mounted on reed plates.

A third embodiment has one reed adjacent to each reed cell, two reed cells and two reeds being associated with each mouthpiece opening. This embodiment can be incorporated into a standard diatonic harmonica and will provide the advantages of a harmonica with internal valve cells and reed valves without the disadvantages created by standard reed valves mounted on reed plates.

Accordingly, harmonicas incorporating the harmonica comb of this invention can be used to improve the tonality and performance of the bending harmonicas described in U.S. Pat. No. 5,367,937, as well as improve the tonality and performance of the standard 10 cell, 20 reed diatonic harmonica, the standard tremolo harmonica, the standard octave harmonica and the standard chromatic harmonica. Furthermore, harmonicas incorporating the harmonica comb of this invention have the further advantages of:

(a) reducing the negative tonal effects of reed valves in standard chromatic and diatonic harmonicas by reducing their close proximity to the reeds;

(b) lowering the production cost of harmonicas incorporating valve cells by combining the draw valve platform and the blow valve platform into a single comb;

(c) reducing the air losses in harmonicas incorporating valve cells by reducing the number of necessary components liable to air loss; and (d) increasing the resonance of the overtones in harmonicas incorporating valve cells by situating the valve cells internal to the reed plates, thereby providing direct contact between the reeds and the outside air.

Although the description above contains many specificities, these should not be construed as limiting the scope of the invention but as merely providing illustrations of some of the presently preferred embodiments of this invention.

Thus the scope of the invention should be determined by the appended claims and their legal equivalents, rather than by the examples given.

What is claimed is:

1. A harmonica comb comprising:

an elongated essentially rectangular body including a front side, a top adjacent side, a bottom adjacent side, a rear side, and two ends with the thickness of said body wider from said front side to said rear side than from said top adjacent side to said bottom adjacent side;

a plurality of cavities or valve cells spaced longitudinally along the central longitudinal axis of said front side of said body, said valve cells separated by cell walls, said valve cells open to said front side of said body and closed at said rear side of said body;

a plurality of blow reed/blow enabler reed cells spaced longitudinally along said top adjacent side, said blow reed/blow enabler reed cells separated by said cell walls, said blow reed/blow enabler reed cells in alignment with said valve cells, the bottom of said blow reed/blow enabler reed cells comprising a blow valve platform with said blow valve platform also comprising the ceiling of said valve cells;

a plurality of draw reed/blow enabler reed cells spaced longitudinally along said bottom adjacent side, said draw reed/draw enabler reed cells separated by said cell walls, said draw reed/draw enabler reed cells in alignment with said valve cells, the top of said draw reed/draw enabler reed cells comprising a draw valve platform with said draw valve platform also comprising the floor of said valve cells;

a blow reed/blow enabler reed valve slot formed in said ceiling of each of said valve cells, said blow reed/blow enabler reed valve slots forming an open passageway between each of said valve cells and each of said blow reed/blow enabler reed cells;

a draw reed/draw enabler reed valve slot formed in said floor of each of said valve cells, said draw reed/draw enabler reed valve slots forming an open passageway between each of said valve cells and each of said draw reed/draw enabler reed cells;

a blow reed/blow enabler reed valve located in each of said blow reed/blow enabler reed cells and positioned over said blow reed/blow enabler reed valve slot, said blow reed/blow enabler reed valve secured at one end to said blow valve platform and said blow reed/blow enabler reed valve free to move at its opposite end; and a draw reed/draw enabler reed valve located in each of said valve cells and positioned over said draw reed/draw enabler reed valve slot, said draw reed/draw enabler reed valve secured at one end to said floor of said valve cells and said draw reed/draw enabler reed valve free to move at its opposite end.

2. A method of manufacturing a harmonica comb comprising the steps of:

molding the top half of a comb including a plurality of upper channels on the bottom side of said top half and a plurality of cells on the top side of said top half, said upper channels open to the front side of said top half and closed at the rear side of said top half, said upper channels and said cells spaced longitudinally along said top half with each of said upper channels in alignment with one of said cells, the bottom of said cells and the top of said upper channels therefore sharing a common wall, said common wall including an aperture or blow reed/blow enabler reed slot formed therein;

securing a check valve or blow reed/blow enabler reed valve at one end to said common wall in each of said cells positioned over said blow reed/blow enabler reed slot in said common wall;

molding the bottom half of a comb including a plurality of lower channels on the top side of said bottom half and a plurality of cells on the bottom side of said bottom half, said lower channels open to the front side of said bottom half and closed at the rear side of said bottom half, said lower channels and said cells spaced longitudinally along said bottom half with each of said lower channels in alignment with one of said cells, the top of said cells and the bottom of said lower channels therefore sharing a common wall, said common wall including an aperture or draw reed/draw enabler reed slot formed therein;

securing a check valve or draw reed/draw enabler reed valve at one end to said common wall in each of said lower channels, said draw reed/draw enabler reed valve in each of said lower channels positioned over said draw reed/draw enabler reed slot in said lower channel; and securing said top half and said bottom half together in an air-tight connection with said upper channels of said top half and said lower channels of said bottom half in alignment.

3. The harmonica comb of claim 1 wherein said elongated body is typically constructed of wood or molded of plastic.

4. The harmonica comb of claim 1 wherein said blow reed/blow enabler reed valves and said draw reed/draw enabler reed valves are typically constructed of plastic such as PVC.

5. The harmonica comb of claim 2 wherein said top half and said bottom half are constructed of a plastic having a specified elasticity enabling said halves to be secured together with screws for an air-tight fit.

6. The harmonica comb of claim 2 wherein said top half and said bottom half are secured together with adhesive.

7. The harmonica comb of claim 1 wherein the height of said front side is less than the height of said rear side.

8. A harmonica produced using the harmonica comb of claim 1 comprising:

a blow plate secured to said top adjacent side, said blow plate closing the open end of said blow reed/blow enabler reed cells;

a draw plate secured to said bottom adjacent side, said draw plate closing the open end of said draw reed/draw enabler reed cells;

a top cover secured to said blow plate;

a bottom cover secured to said draw plate; and a mouthpiece secured to the front side of said harmonica comb.

9. The harmonica of claim 8 wherein said blow plate further includes:

a blow reed;

a blow reed and a blow enabler reed; or two blow reeds.

10. The harmonica of claim 8 wherein said draw plate further includes:

a draw reed;

a draw reed and a draw enabler reed; or two draw reeds.

* * * * *